US008537092B2

(12) United States Patent
Woo et al.

(10) Patent No.: US 8,537,092 B2
(45) **Date of Patent: *Sep. 17, 2013**

(54) SHARED BUFFER DISPLAY PANEL DRIVE METHODS AND SYSTEMS

(75) Inventors: Jae Hyuck Woo, Gyeonggi-do (KR); Jae Goo Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/425,552

(22) Filed: Mar. 21, 2012

(65) Prior Publication Data

US 2012/0176391 A1 Jul. 12, 2012

Related U.S. Application Data

(63) Continuation of application No. 10/860,419, filed on Jun. 3, 2004, now Pat. No. 8,144,100.

(30) Foreign Application Priority Data

Dec. 17, 2003 (KR) ..... 10-2003-0092613

(51) Int. Cl.
*G09G 3/36* (2006.01)
*G09G 5/00* (2006.01)

(52) U.S. Cl.
USPC ..... 345/98; 345/204

(58) Field of Classification Search
USPC ..... 345/98, 204
See application file for complete search history.

(56) References Cited

U.S. PATENT DOCUMENTS

| | | | |
|---|---|---|---|
| 4,218,768 | A | 8/1980 | Hassler |
| 5,907,515 | A | 5/1999 | Hatakeyama |
| 6,104,364 | A | 8/2000 | Hayashi |
| 6,226,537 | B1 | 5/2001 | Namura et al. |
| 6,417,868 | B1 | 7/2002 | Bock et al. |
| 6,424,328 | B1 | 7/2002 | Ino et al. |
| 6,480,039 | B1 | 11/2002 | Feurle |
| 6,567,066 | B1 | 5/2003 | Hashimoto |
| 6,597,349 | B1 | 7/2003 | Koyama et al. |
| 6,642,916 | B1 | 11/2003 | Kodama et al. |

(Continued)

FOREIGN PATENT DOCUMENTS

| | | |
|---|---|---|
| JP | 10-333643 | 12/1998 |
| JP | 11-346337 | 12/1999 |

(Continued)

OTHER PUBLICATIONS

Notice to Submit a Response to Korean Patent Application No. 10-2004-0070028 mailed on Mar. 21, 2006.

(Continued)

*Primary Examiner* — Adam J Snyder
(74) *Attorney, Agent, or Firm* — Myers Bigel Sibley & Sajovec, PA

(57) ABSTRACT

Methods of driving source lines and/or circuits/systems for driving source lines are provided. Source lines of a display device are driven by comparing first data for driving a first buffer associated with a first source line of the display device and second data for driving a second buffer associated with a second source line of the display device and selectively disabling the second buffer and driving the second source line of the display device with the first buffer based on the comparison of the first and second data.

19 Claims, 8 Drawing Sheets

(56) References Cited

U.S. PATENT DOCUMENTS

| | | | | |
|---|---|---|---|---|
| 6,670,935 | B2 | 12/2003 | Yeon | |
| 6,727,880 | B2 | 4/2004 | Lee | |
| 6,806,860 | B2 | 10/2004 | Saito et al. | |
| 6,816,144 | B2 | 11/2004 | Tsuchi | |
| 7,046,224 | B2 * | 5/2006 | Monomohshi | 345/89 |
| 7,133,011 | B2 | 11/2006 | Ha | |
| 7,142,048 | B2 | 11/2006 | Miyagaki et al. | |
| 7,808,320 | B1 | 10/2010 | Kuo | |
| 2002/0118184 | A1 | 8/2002 | Yeon | |
| 2002/0167504 | A1 | 11/2002 | Matsumoto | |
| 2003/0030614 | A1 | 2/2003 | Tajima et al. | |
| 2003/0117360 | A1 * | 6/2003 | Bu | 345/90 |
| 2003/0146909 | A1 * | 8/2003 | Maki | 345/204 |
| 2003/0160752 | A1 | 8/2003 | Park | |
| 2003/0234757 | A1 | 12/2003 | Bu | |
| 2003/0234758 | A1 | 12/2003 | Bu et al. | |

FOREIGN PATENT DOCUMENTS

| | | |
|---|---|---|
| JP | 2002-108301 | 4/2002 |
| JP | 2004-029752 | 1/2004 |
| KR | 10-2003-0089640 | 11/2003 |

OTHER PUBLICATIONS

Translation of Japanese Office Action for JP2004-36661, dated Feb. 1, 2011.

* cited by examiner

SHARED BUFFER DISPLAY PANEL DRIVE METHODS AND SYSTEMS

CLAIM OF PRIORITY

This U.S. non-provisional patent application claims priority under 35 U.S.C. §120 as a continuation application of U.S. patent application Ser. No. 10/860,419, filed Jun. 3, 2004, which in turn claims priority under 35 U.S.C. §119 from Korean Patent Application No. 10-2003-0092613, filed on Dec. 17, 2003. The entire contents of both of the above applications are hereby incorporated by reference in their entireties.

FIELD OF THE INVENTION

The present invention relates to displays and, more particularly, to driving source lines of displays.

BACKGROUND OF THE INVENTION

Active matrix liquid crystal displays include a matrix of pixels that each include red, green and blue cells. Each cell has a transistor that controls the operations of the cell. Cells in the same line of the display typically have the gate electrode of their transistors commonly connected by a gate line. Cells in the same column typically have their source electrodes commonly connected by a source line. Thus, each cell of each pixel may be individually addressable through selection of a gate line and a source line.

Information to be displayed by the liquid crystal display is typically provided as a digital value that is converted to an analog signal to drive a source line. Conventionally, a separate buffer is provided to drive each cell source line for the liquid crystal display. An example of a conventional source driver circuit 100 for three cell sources lines of a column of pixels is illustrated in FIG. 1. As seen in FIG. 1, digital data, such as 18 bit digital data, provides a red value (e.g., 6 bits) DATA_R, a green value (e.g., 6 bits) DATA_G and a blue value (e.g., 6 bits) DATA_B. The digital data is converted to a corresponding analog value R_VOL, G_VOL and B_VOL by respective digital to analog converters DR, DG and DB. The analog values are driven onto lines of a display panel, such as source lines in a liquid crystal display (LCD) panel, by buffers R_BUF, G_BUF and B_BUF to provide red, green and blue drive voltages ROUT, GOUT and BOUT. Typically, each source line of a display will have its own driver circuit as illustrated in FIG. 1 and these drivers are typically all in an on-state during operation of the LCD panel, thereby, consuming power.

FIG. 2 is a further illustration of a conventional source line driver circuit for a LCD display that includes selective switching of connectivity to buffers so as to reduce the number of leads needed to test the circuit. By providing the switches GRAY_ON and CH_MUX, a single lead may be selectively connected to the buffer amplifier 10 and the buffer amplifier 20 for test purposes. Furthermore, the buffer amplifiers 10 and 20 also may be disabled for test purposes by the signal AMP_ON/OFF.

SUMMARY OF THE INVENTION

Embodiments of the present invention provide for driving source lines of a display device by comparing first data for driving a first buffer associated with a first source line of the display device and second data for driving a second buffer associated with a second source line of the display device and selectively disabling the second buffer and driving the second source line of the display device with the first buffer based on the comparison of the first and second data.

In further embodiments of the present invention, the first data and the second data are corresponding red data, green data and/or blue data associated with the first source line and the second source line. The first data may be one of red data, green data or blue data and the second data may be a corresponding one of red data, green data or blue data. The first source line and the second source line may be corresponding ones of source lines associated with two different pixels.

In additional embodiments of the present invention, the first data is one of red data, green data or blue data and the second data is a different one of red data, green data or blue data.

In still further embodiments of the present invention, the comparison of the first data and the second data is provided by determining if the first data and the second data have a same value.

In certain embodiments of the present invention where the first data and the second data comprise RGB data for two different pixels, the first buffer includes a first red source line buffer, a first green source line buffer and a first blue source line buffer and the second buffer includes a second red source line buffer, a second green source line buffer and a second blue source line buffer. Selectively disabling the second buffer further may be provided by selectively decoupling the second buffer from the second source line when the first buffer drives the first source line and the second source line. Selectively disabling the second buffer may also include selectively disabling a differential amplifier input circuit and/or an output drive circuit of the second buffer.

In some embodiments of the present invention, the first source line and the second source line are source lines of a same pixel. The first source line and the second source line could also be source lines for different pixels. The first data and the second data may include corresponding red data, green data blue data and/or white data associated with the first source line and the second source line. The display device may be a liquid crystal display.

In additional embodiments of the present invention, comparing first data for driving a first buffer associated with a first source line of the display device and second data for driving a second buffer associated with a second source line of the display device includes comparing first data for driving a plurality of first buffers associated with a first plurality of source lines and second data for driving a plurality of second buffers associated with a second plurality of source lines. Selectively disabling the second buffer and driving the second source line of the display device with the first buffer based on the comparison of the first and second data includes selectively disabling the second plurality of buffers and driving the second plurality of source lines of the display device with the first plurality of buffers based on the comparison of the first and second data.

In other embodiments of the present invention, source lines of a display device are driven by comparing data for driving a first source line of the display device with data for driving at least one other source line of the display device and selectively driving the at least one other source line and the first source line with a common source line buffer based on the data comparison. A source line buffer of the at least one other source line is deactivated if the at least one other source line is driven by the common source line buffer.

In further embodiments of the present invention, comparing data includes comparing data for driving a first source line of the display device with data for driving each of a plurality of other source lines of the display device. Selectively driving the at least one other source line and the first source line with a common source line buffer based on the data comparison includes driving the first source line and selected ones of the plurality of other source lines with the common source line buffer and deactivating a source line buffer includes deactivating source line buffers for each of the plurality of source lines driven by the common source line buffer.

In additional embodiments of the present invention, driving the first source line and selected ones of the plurality of other source lines with the common buffer includes driving the first source line and each of the plurality of other source lines with the common source line buffer. Deactivating a source line buffer may include selectively disabling a differential amplifier input circuit and/or an output drive circuit of the source line buffer. The first source line and the at least one other source line may be source lines of a same pixel or different pixels. The first source line and the at least one other source line may be source lines associated with a same color component for at least two different pixels. The first source line and the at least one other source line could also be source lines associated with different color components and may be for the same pixel or different pixels.

In still further embodiments of the present invention, the first source line includes a first plurality of source lines and the at least one other source line includes a second plurality of source lines. Comparing data for driving a first source line of the display device with data for driving at least one other source line of the display device includes comparing data for driving the first plurality of source lines of the display device with data for driving the second plurality of source lines of the display device. Selectively driving the at least one other source line and the first source line with a common source line buffer based on the data comparison includes selectively driving the second plurality of source lines and the first plurality of source lines with a plurality of common source line buffers based on the data comparison. Deactivating a source line buffer of the at least one other source line if the at least one other source line is driven by the common source line buffer includes deactivating source line buffers of the second plurality of source lines if the second plurality of source lines is driven by the plurality of common source line buffers. The data for driving the first plurality of source lines of the display device and the data for driving the second plurality of source lines of the display device may include RGB data.

In some embodiments of the present invention, comparing data for driving the first plurality of source lines of the display device with data for driving the second plurality of source lines of the display device may also include comparing components of the data for driving the first plurality of source lines of the display device with corresponding components of the data for driving the second plurality of source lines of the display device. Comparing data for driving the first plurality of source lines of the display device with data for driving the second plurality of source lines of the display device could also include comparing all the data for driving the first plurality of source lines of the display device with all the data for driving the second plurality of source lines of the display device.

In certain embodiments of the present invention, the data for driving a first source line of the display device includes red, green, blue and/or white data and the data for driving at least one other source line of the display device includes red, green, blue and/or white data. The display device may be a liquid crystal display panel.

In yet other embodiments of the present invention, a buffer circuit for driving source lines of a display device includes a data comparator circuit that compares a first data value associated with a first source line of the display device and a second data value associated with a second source line of the display device, a first buffer that drives the first source line based on a first data value, a second buffer that drives the second source line based on the second data value. The second buffer is responsive to the data comparator circuit so as to selectively disable the second buffer and a first switching circuit configured to selectively electrically couple the first buffer to the second source line responsive to the data comparator circuit.

The first data and the second data may include corresponding red data, green data and/or blue data associated with the first source line and the second source line. The first data may also include one of red data, green data or blue data and the second data may include a corresponding one of red data, green data or blue data, where the first source line and the second source lines are corresponding ones of source lines associated with two different pixels of the display device. The first data may be one of red data, green data or blue data and the second data may be a different one of red data, green data or blue data. The data comparator circuit may be configured to determine if the first data and the second data have a same value.

In further embodiments of the present invention, where the first data and the second data are RGB data for two different pixels of the display device, the first buffer includes a first red buffer configured to drive a first red source line, a first green buffer configured to drive a first green source line and a first blue buffer configured to drive a first blue source line. The second buffer includes a second red buffer configured to drive a second red source line and configured to be selectively disabled responsive to the data comparator circuit, a second green buffer configured to drive a second green source line and configured to be selectively disabled responsive to the data comparator circuit and a second blue buffer configured to drive a second blue source line and configured to be selectively disabled responsive to the data comparator circuit. The first switching circuit is configured to selectively electrically couple the first red buffer to the second red source line responsive to the data comparator circuit, the first blue buffer to the second blue source line responsive to the data comparator circuit and the first green buffer to the second green source line responsive to the data comparator circuit.

In additional embodiments of the present invention, a second switching circuit is configured to selectively electrically decouple the second buffer from the second source line responsive to the data comparator circuit so that the second buffer is decoupled from the second source line if the first buffer is coupled to the second source line. The data comparator circuit may include a plurality of logic gates that compare corresponding data bits of the first and second data values, an aggregating logic gate that aggregates outputs of the plurality of logic gates and outputs a first signal if the outputs of the plurality of logic gates are all of a same logic value and a plurality of multiplexers that selectively provide control signals to the first and second switching circuits based on the output of the aggregating logic gate. The plurality of logic gates may include a plurality of XOR gates and the aggregating logic gate may be a NOR gate. The aggregating logic gate may include a plurality of logic gates.

The plurality of multiplexers may include a first multiplexer configured to generate a control signal to control operation of the second buffer, a second multiplexer configured to generate a control signal to control operation of the first switching circuit to couple the first buffer to the second source line and a third multiplexer configured to generate a control signal to control operation of the second switching circuit to decouple the second buffer from the second source line.

In further embodiments of the present invention, the second buffer includes an input circuit configured to selectively disconnect transistors from a voltage source if the second buffer is disabled. The second buffer may also include an output circuit configured to control output drive transistors of the output circuit to decouple an output line of the second buffer from output voltage sources of the second buffer.

Additional embodiments of the present invention provide for driving first and second source lines of a display panel utilizing first and second buffer amplifiers by selecting one of the first buffer amplifier and the second buffer amplifier to drive the second source line based on values of display data driven on the first and second source lines. The second buffer amplifier may be disabled if the first buffer amplifier is selected to drive the second source line. The first and second source lines may be for a same pixel or different pixels of the display panel.

In further embodiments of the present invention, selecting one of the first buffer amplifier and the second buffer amplifier to drive the second source line based on values of display data driven on the first and second source lines includes selecting the first buffer amplifier to drive the second source line if the values of display data driven on the first and second source lines are the same and selecting the second buffer amplifier to drive the second source line if the values of display data driven on the first and second source lines are different. Additionally, the second source line may be driven with the first buffer amplifier if the first buffer amplifier is selected to drive the second source line and the second source line may be driven with the second buffer amplifier if the second buffer amplifier is selected to drive the second source line.

In yet other embodiments of the present invention, a display device includes a display panel, a data comparator circuit configured to compare display data values and a plurality of source line drivers configured to receive display data and drive source lines of the display device based on the received display data. A source line switching network responsive to the data comparator circuit and the plurality of source line drivers selectively couples differing source lines of the display device with respective ones of the plurality of source line drivers based on the comparison of the display data values.

In some embodiments of the present invention, the plurality of source line drivers are responsive to the data comparator circuit to selectively deactivate respective ones of the plurality of source line drivers based on the comparison of the display data values. The source line switching network may also be configured to decouple deactivated ones of the plurality of source line drivers from source lines of the display device. The source line switching network may be configured to couple one source line driver to two source lines of the display panel if the data comparator circuit determines that the display data values corresponding to the two source lines are the same. The display panel may be a liquid crystal display panel or an organic light emitting device

DETAILED DESCRIPTION OF THE INVENTION

The present invention will now be described more fully with reference to the accompanying drawings, in which embodiments of the invention are shown. This invention may, however, be embodied in different forms and should not be construed as being limited to the embodiments set forth herein. Rather, these embodiments are provided so that this disclosure will be thorough and complete, and will fully convey the scope of the invention to those skilled in the art. Like numbers refer to like elements. As used herein the term "and/or" includes any and all combinations of one or more of the associated listed items.

It will be understood that although the terms first and second may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, for example, a first element, component, region, layer, or section discussed below could be termed a second element, component, region, layer, or section without departing from the teachings of the present invention.

Embodiments of the present invention provide methods and/or systems for controlling drivers (buffers) that drive display values onto source lines of a display device based on display data values. As used herein, the term "source line" refers to a line of a display device on which a signal corresponding to a value to be displayed by the display device is driven. A source line may be contrasted with a "gate line" which is a control line of the display device that selects a display element of the display device. Embodiments of the present invention are described herein with reference to a liquid crystal display panel, however, embodiments of the present invention may be utilized with other types of displays. For example, the display panel may be a liquid crystal display (LCD) panel, a plasma display panel, an organic light emitting device (OLED) or other such display panels.

Embodiments of the present invention provide for selectively driving at least two source lines of a display with a common source line buffer amplifier if the data to be driven on the source lines is the same. A source line buffer amplifier associated with one of the source lines may be disabled if the source lines are being driven by the common source line buffer amplifier. Thus, the power consumption of drive circuits according to embodiments of the present invention may be reduced over conventional drive circuits. The data for the two source lines may be data for a common color (e.g. red, green, blue and/or white) for two different pixels, may be data from different colors for a same pixel and/or different pixels and/or for multiple colors for a same and/or different pixel.

Figure 1:
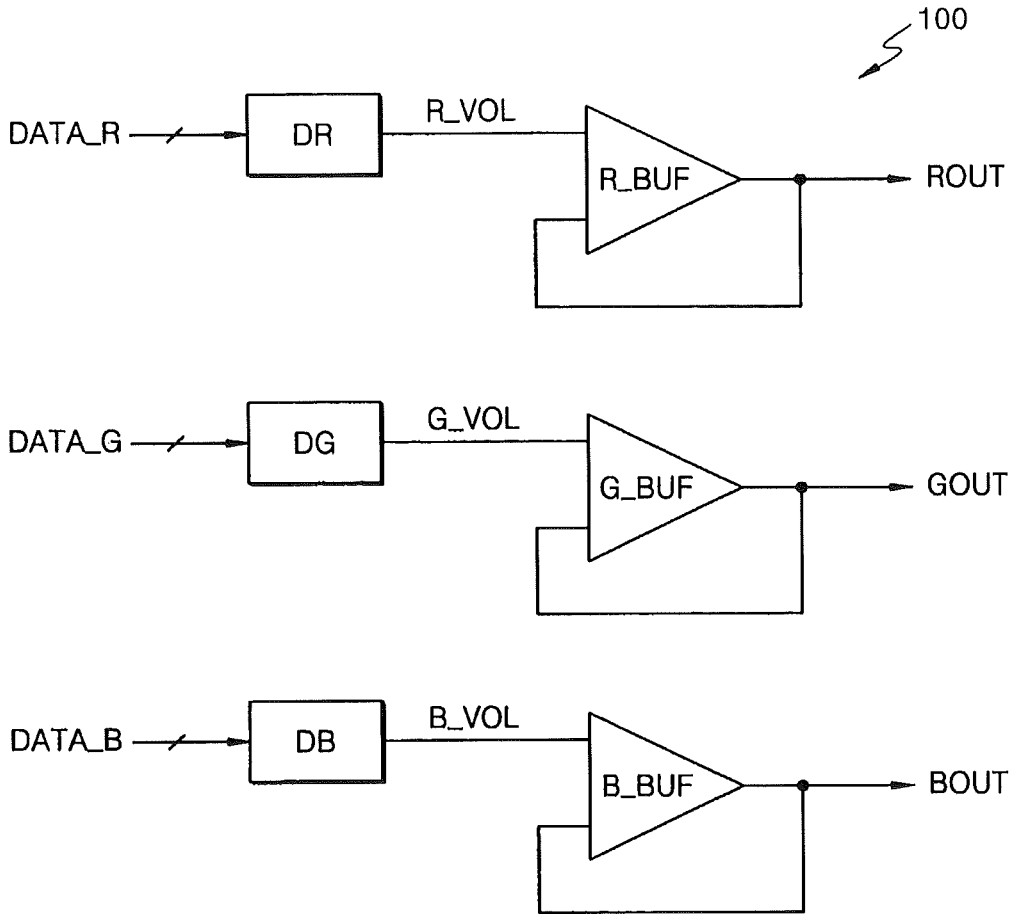
FIG. 1 (PRIOR ART)
FIG. 1 is a schematic diagram of a conventional source line drive circuit of a liquid crystal display.
Figure 2:
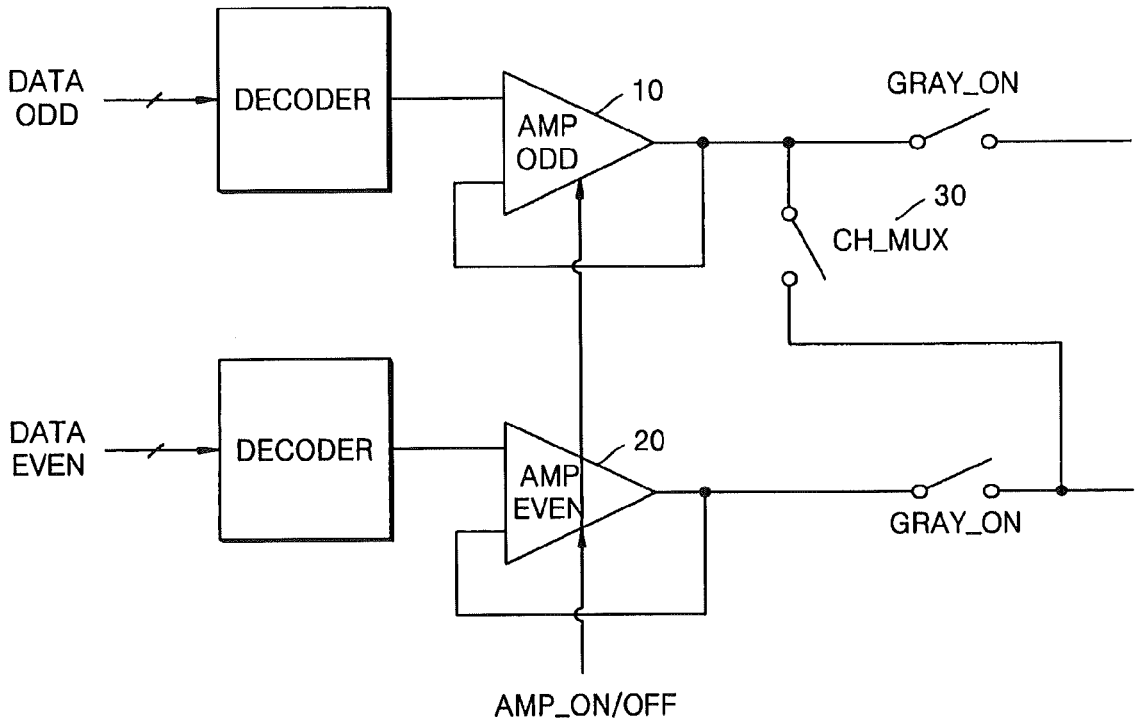
FIG. 2 (PRIOR ART)
FIG. 2 is a schematic diagram of a conventional source line drive circuit of a liquid crystal display.
Figure 3:
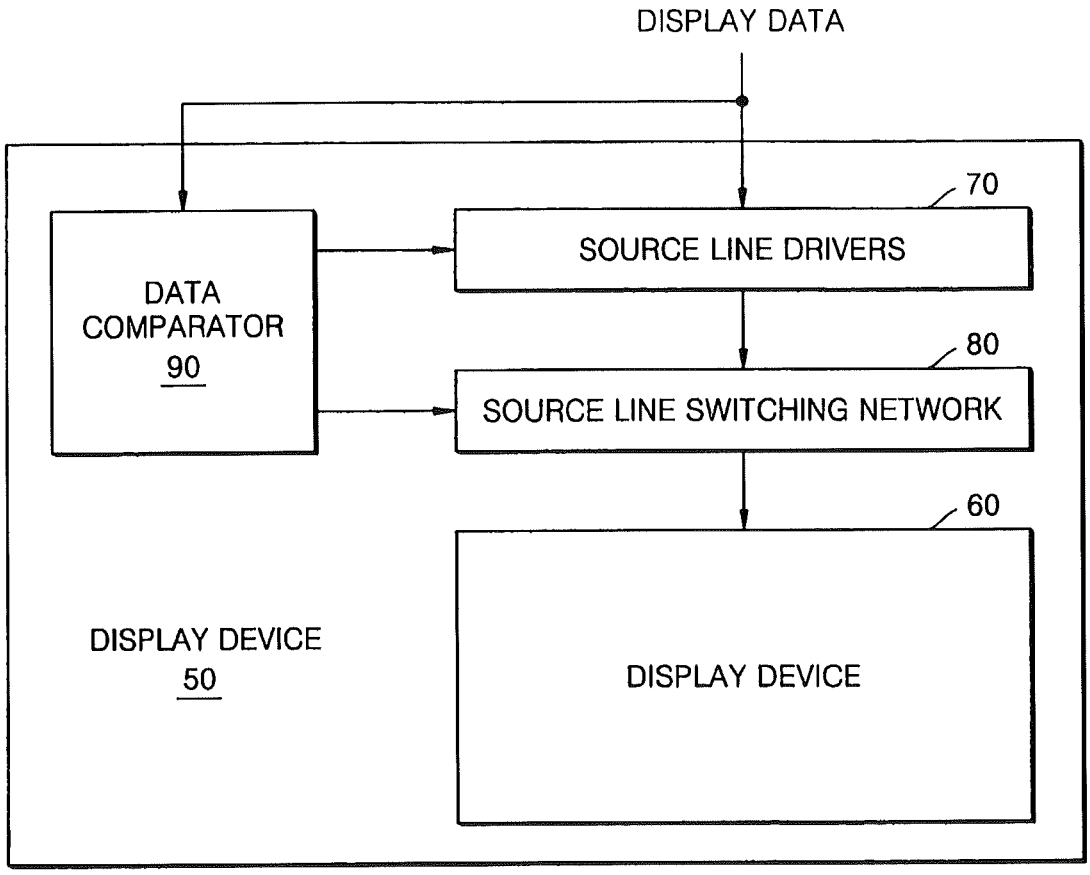
FIG. 3 is a block diagram of a display device incorporating embodiments of the present invention.

FIG. 3 is a block diagram illustrating some embodiments of the present invention. As seen in FIG. 3, a display device 50 includes a display panel 60, a data comparator circuit 90 configured to compare display data values, a plurality of source line drivers 70 configured to receive display data and drive source lines of the display device 60 based on the received display data and a source line switching network 80 responsive to the data comparator circuit 90 and the plurality of source line drivers 70 to selectively couple differing source lines of the display device 60 with respective ones of the plurality of source line drivers 70 based on the comparison of the display data values. The plurality of source line drivers 70 are also responsive to the data comparator circuit 90 to selectively deactivate respective ones of the plurality of source line drivers 70 based on the comparison of the display data values. The source line switching network 80 is configured to decouple deactivated ones of the plurality of source line drivers 70 from source lines of the display device 60. The source line switching network 70 may also be configured to couple one source line driver to two or more source lines of the display panel 60 if the data comparator circuit 90 determines that the display data values corresponding to the two or more source lines are the same.

The comparison of display data may compare any data values for two or more source lines and, if the values are equal, drive the two or more source lines with a common buffer amplifier of the source line drivers 70. The resolution of the comparison may be at the pixel level or at a sub-pixel level. For example, the comparison may be made between data for two source lines and the two source lines driven by a single buffer amplifier. The two values may be compared irrespective of the significance of the two compared data values as to a final display so long as driving the source lines based on the data results in the same display irrespective of whether the source lines are driven by a single buffer amplifier or two separate buffer amplifiers. For example, the two data values may correspond to values for the same color component to be displayed for two different pixels, values for different color components for the same or different pixels or for combinations of color components. Whatever the resolution of comparison of the data values, the resolution of control of the driving of the source lines should be at the same resolution. Thus, for example, if the control of driving the source lines is at the pixel level, then the comparison of data should be at the pixel level. Likewise, if the control of driving the source lines is at the component or channel level, then the comparison of data should be at the component or channel level.

The particular configuration of the source line drivers 70, the source line switching network 80 and the data comparator circuit 90 may depend on the resolution of control that is desired and the level of complexity that is acceptable for a particular application. Furthermore, the source line switching network 70 may be provided by any circuit that provides for the selective coupling of buffer amplifiers to source lines as described herein. Accordingly, embodiments of the present invention should not be construed as limited to a particular circuit or configuration but may include any circuit capable of carrying out the selective coupling and/or deactivation of source line drivers to source lines based on a comparison of data associated with the source lines.

Particular, non-limiting, exemplary embodiments of the present invention will now be described with reference to the schematic illustrations of FIGS. 4 through 8.

Figure 4:
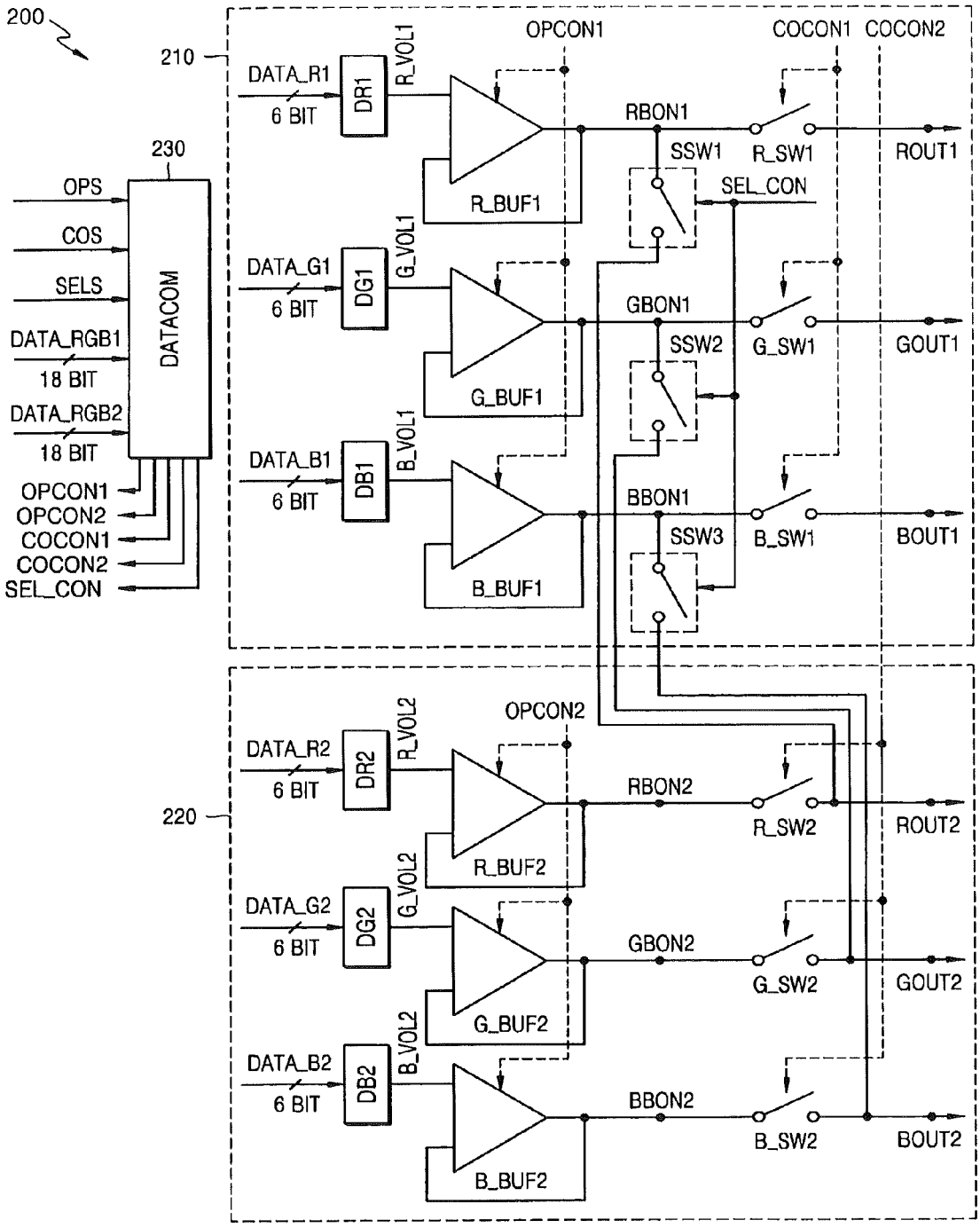
FIG. 4 a schematic diagram of a portion of a circuit for driving source lines of a display device according to embodiments of the present invention.

FIG. 4 is a block diagram of a portion of a source line driver circuit 200 according to some embodiments of the present invention. As seen in FIG. 4, the source line driver circuit 200 includes a first set of source line driver circuitry 210 for a first pixel and a second set of source line driver circuitry 220 for a second pixel. A data comparator circuit 230 receives as input RGB data for two pixels in two columns of pixels of a display panel driven by the source line driver circuits 210, 220 and, optionally, common control signals for controlling operation of the source line driver circuits such as the source line driver circuits 210, 220. The data comparator circuit uses the received RGB data and, optionally, control signals, to generate individual control signals to provided coordinated control of the source line driver circuits 210, 220.

As seen in FIG. 4, in some embodiments of the present invention, the RGB data input to the data comparator circuit is 18 bit RGB data (DATA_RGB1 and DATA_RGB2) which may be provided as 6 bit red, green and blue data (DATA_R1, DATA_G1, DATA_B1, DATA_R2, DATA_G2 and DATA_B2) to respective digital to analog converters (DR1, DG1, DB1, DR2, DG2 and DB2) of the source line driver circuits 210, 220. The digital to analog converters (DR1, DG1, DB1, DR2, DG2 and DB2) convert the digital RGB data to analog values (R_VOL1, G_VOL1, B_VOL1, R_VOL2, G_VOL, and B_VOL2) which are provided to corresponding buffer amplifiers (R_BUF1, G_BUF1, B_BUF1, R_BUF2, G_BUF2, and B_BUF2).

The buffer amplifiers are controlled by corresponding control signals OPCON1 and OPCON2 to selectively deactivate or set to an off state, the buffer amplifiers. The outputs (RBON1, GBON1, BBON1, RBON2, GBON2, and BBON2) of the buffer amplifiers (R_BUF1, G_BUF1, B_BUF1, R_BUF2, G_BUF2, and B_BUF2) are selectively coupled to corresponding output lines ROUT1, GOUT1, BOUT1, ROUT2, GOUT2, and BOUT2 of the source line driver circuits 210, 220 by two separately controlled sets of switches (R_SW1, G_SW1, B_SW1, R_SW2, G_SW2, and B_SW2). The first set of switches (R_SW1, G_SW1 and B_SW1) are controlled by the control signal COCON1 and the second set of switches (R_SW2, G_SW2 and B_SW2) are controlled by the control signal COCON2.

Furthermore, the outputs (RBON1, GBON1, and BBON1) of the buffer amplifiers (R_BUF1, G_BUF1, and B_BUF1) are selectively coupled to the output lines (ROUT2, GOUT2, and BOUT2) by a third set of switches (SSW1, SSW2 and SSW3). The third set of switches (SSW1, SSW2 and SSW3) are controlled by the control signal SEL_CON.

The OPS, COS and/or SELS signals may be global select and control signals that are used in generating the pixel level control signals OPCON1, OPCON2, COCON1, COCON2 and/or SEL_CON. The signals OPS, COS and/or SELS may also be provided as test mode signals that are passed through by the data comparator circuit 230 to the source line driver circuits 210, 220, for example, by logic ORing corresponding ones of the signals OPS, COS and/or SELS with the pixel level control signals OPCON1, OPCON2, COCON1, COCON2 and/or SEL_CON generated by the data comparator circuit 230. In such a way the reduced pin count test equipment may be utilized with embodiments of the present invention.

In operation, the data comparator circuit 230 compares the 18 bit RGB data for two pixels (DATA_RGB1 and DATA_RGB2) and if the data has the same value, controls the source line driver circuits 210, 220 to disable the buffers R_BUF2, G_BUF2 and B_BUF2 of the second source line driver circuit 220 and drive the outputs ROUT1, GOUT1, BOUT1, ROUT2, GOUT2, and BOUT2 with the first source line driver circuit 210. Thus, the buffer amplifiers R_BUF1, G_BUF1 and B_BUF1 provide common buffer amplifiers for driving both sets of source lines based on the data comparison. In particular, the following truth table describes the state of the control signals based on the results of the data comparison

| Comparison | OPCON1 | OPCON2 | COCON1 | COCON2 | SEL_CON |
|---|---|---|---|---|---|
| DATA_RGB1 = DATA_RGB2 | Active | Inactive | Active | Inactive | Active |
| DATA_RGB1 ≠ DATA_RGB2 | Active | Active | Active | Active | Inactive |

In the above table, an active signal results in closure of the corresponding switches or activation of the buffer amplifier. Thus, for example, when OPCON2 is active, the buffer amplifiers R_BUF2, G_BUF2 and B_BUF2 are enabled and when it is inactive, the buffer amplifiers R_BUF2, G_BUF2 and B_BUF2 are disabled. Similarly, when the signal SEL_CON is active, the switches SSW1, SSW2 and SSW3 are closed and when the signal SEL_CON is inactive, the switches SSW1, SSW2 and SSW3 are open.

Figure 5:
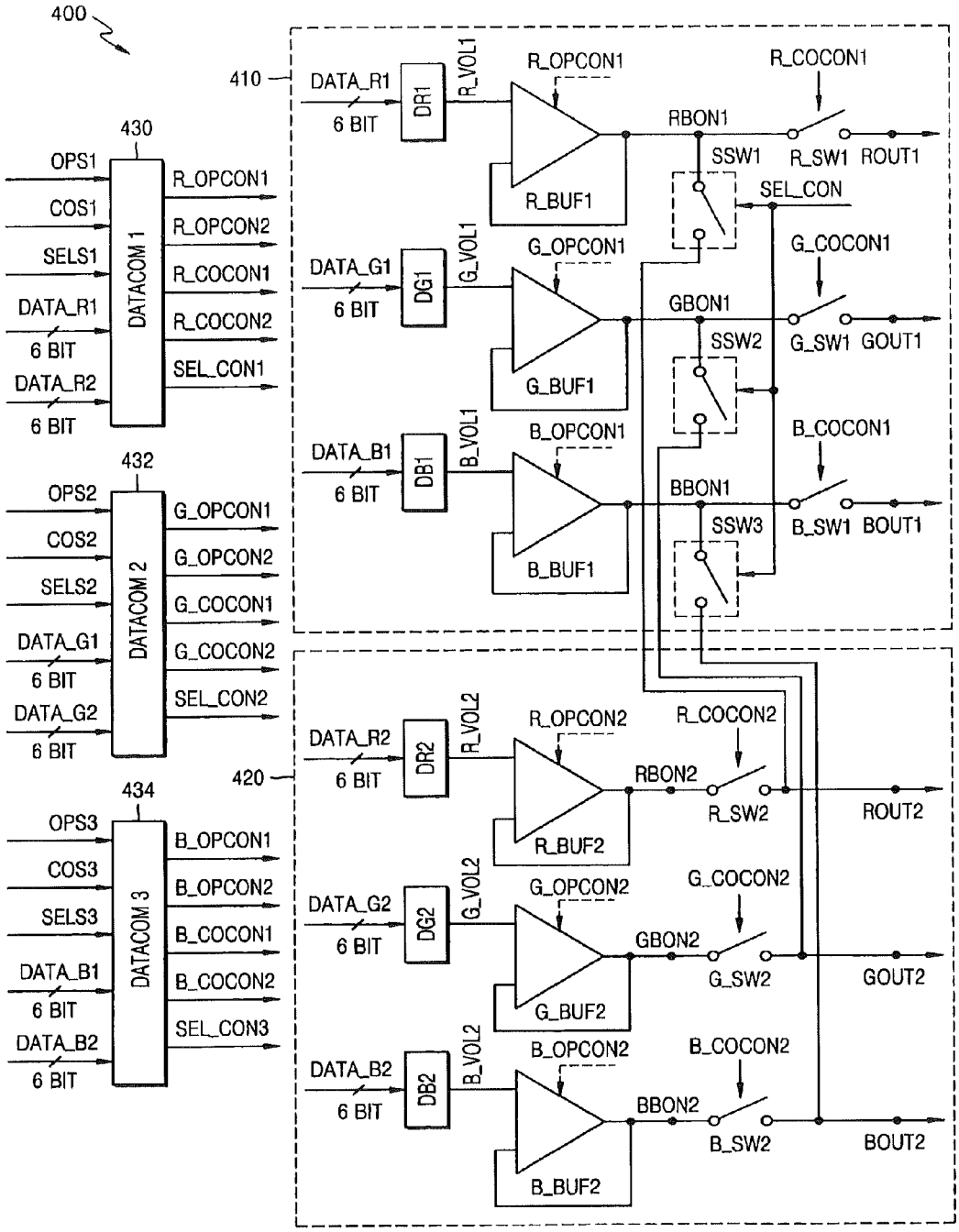
FIG. 5 a schematic diagram of a portion of a circuit for driving source lines of a display device according to additional embodiments of the present invention.

FIG. 4 illustrates embodiments of the present invention where the comparison of data is made at a pixel level such that if two pixels have the same value, then the buffer amplifiers associated with one of the pixels are disabled and the source lines of both pixels are driven by buffer amplifiers for one of the pixels. FIG. 5 illustrates a source line driver circuit 400 according to further embodiments of the present invention where the comparison of data is made between pixels at the data component level. Thus, as seen in FIG. 5, three data comparator circuits 430, 432 and 434 are provided that compare values for components of two pixel's data to control source line driver circuits 410, 420.

The buffer amplifiers of the source line driver circuits 410, 420 are controlled by corresponding control signals R_OPCON1, R_OPCON2, G_OPCON1, G_OPCON2, B_OPCON1 and B_OPCON2 to selectively deactivate or set to an off state, the buffer amplifiers. The outputs (RBON1, GBON1, BBON1, RBON2, GBON2, and BBON2) of the buffer amplifiers (R_BUF1, G_BUF1, B_BUF1, R_BUF2, G_BUF2, and B_BUF2) are selectively coupled to corresponding output lines ROUT1, GOUT1, BOUT1, ROUT2, GOUT2, and BOUT2 of the source line driver circuits 410, 420 by individually controlled switches (R_SW1, G_SW1, B_SW1, R_SW2, G_SW2, and B_SW2).

Furthermore, the outputs (RBON1, GBON1, and BBON1) of the buffer amplifiers (R_BUF1, G_BUF1, and B_BUF1) are selectively coupled to the output lines (ROUT2, GOUT2, and BOUT2) by individually controlled switches (SSW1, SSW2 and SSW3).

The first comparator circuit 430 compares red component values DATA_R1 and DATA_R2 for two pixels and controls the buffer amplifiers R_BUF1 and R_BUF2 and the switches SSW1, R_SW1 and R_SW2 based on this comparison by generating R_OPCON1, R_OPCON2, R_COCON1, R_COCON2 and SEL_CON1. The second comparator circuit 432 compares green component values DATA_G1 and DATA_G2 for two pixels and controls the buffer amplifiers G_BUF1 and G_BUF2 and the switches SSW2, G_SW1 and G_SW2 based on this comparison by generating G_OPCON1, G_OPCON2, G_COCON1, G_COCON2 and SEL_CON2. The third comparator circuit 434 compares blue component values DATA_B1 and DATA_B2 for two pixels and controls the buffer amplifiers B_BUF1 and B_BUF2 and the switches SSW3, B_SW1 and B_SW2 based on this comparison by generating B_OPCON1, B_OPCON2, B_COCON1, B_COCON2 and SEL_CON3.

In a manner similar to that discussed above with reference to FIG. 4, the OPS1, COS1, SELS1, OPS2, COS2, SELS2, OPS3, COS3 and/or SELS3 signals may be global select and control signals that are used in generating the pixel component level control signals R_OPCON1, R_OPCON2, R_COCON1, R_COCON2, SEL_CON1, G_OPCON1, G_OPCON2, G_COCON1, G_COCON2, SEL_CON2, B_OPCON1, B_OPCON2, B_COCON1, B_COCON2 and/or SEL_CON3. The signals OPS1, COS1, SELS1, OPS2, COS2, SELS2, OPS3, COS3 and/or SELS3 may also be provided as test mode signals that are passed through by the data comparator circuits 430, 432 and 434 to the source line driver circuits 410, 420, for example, by logic ORing corresponding ones of the signals OPS1, COS1, SELS1, OPS2, COS2, SELS2, OPS3, COS3 and/or SELS3 with the pixel component level control signals R_OPCON1, R_OPCON2, R_COCON1, R_COCON2, SEL_CON1, G_OPCON1, G_OPCON2, G_COCON1, G_COCON2, SEL_CON2, B_OPCON1, B_OPCON2, B_COCON1, B_COCON2 and/or SEL_CON3 generated by the corresponding data comparator circuits 430, 432 or 434. In such a way the reduced pin count test equipment may be utilized with embodiments of the present invention.

In operation, the data comparator circuits 430, 432 and 434 compare the 6 bit RGB component data for two pixels and if the data has the same value, controls the source line driver circuits 410, 420 for the component to disable the corresponding one of the buffers R_BUF2, G_BUF2 and B_BUF2 of the second source line driver circuit 420 and drive the corresponding ones of the outputs ROUT1, GOUT1, BOUT1, ROUT2, GOUT2, and BOUT2 with the first source line driver circuit 410. Thus, the buffer amplifiers R_BUF1, G_BUF1 and B_BUF1 provide common buffer amplifiers for driving corresponding ones of the two sets of source lines based on the data comparison. In particular, the following truth tables describe the state of the control signals based on the results of the data comparison

| Comparison | R_OPCON1 | R_OPCON2 | R_COCON1 | R_COCON2 | SEL_CON1 |
|---|---|---|---|---|---|
| DATA_R1 = DATA_R2 | Active | Inactive | Active | Inactive | Active |
| DATA_R1 ≠ DATA_R2 | Active | Active | Active | Active | Inactive |

| Comparison | G_OPCON1 | G_OPCON2 | G_COCON1 | G_COCON2 | SEL_CON2 |
|---|---|---|---|---|---|
| DATA_G1 = DATA_G2 | Active | Inactive | Active | Inactive | Active |
| DATA_G1 ≠ DATA_G2 | Active | Active | Active | Active | Inactive |

| Comparison | B_OPCON1 | B_OPCON2 | B_COCON1 | B_COCON2 | SEL_CON3 |
|---|---|---|---|---|---|
| DATA_B1 = DATA_B2 | Active | Inactive | Active | Inactive | Active |
| DATA_B1 ≠ DATA_B2 | Active | Active | Active | Active | Inactive |

In the above tables, an active signal results in closure of the corresponding switches or activation of the buffer amplifier.

Figure 6:
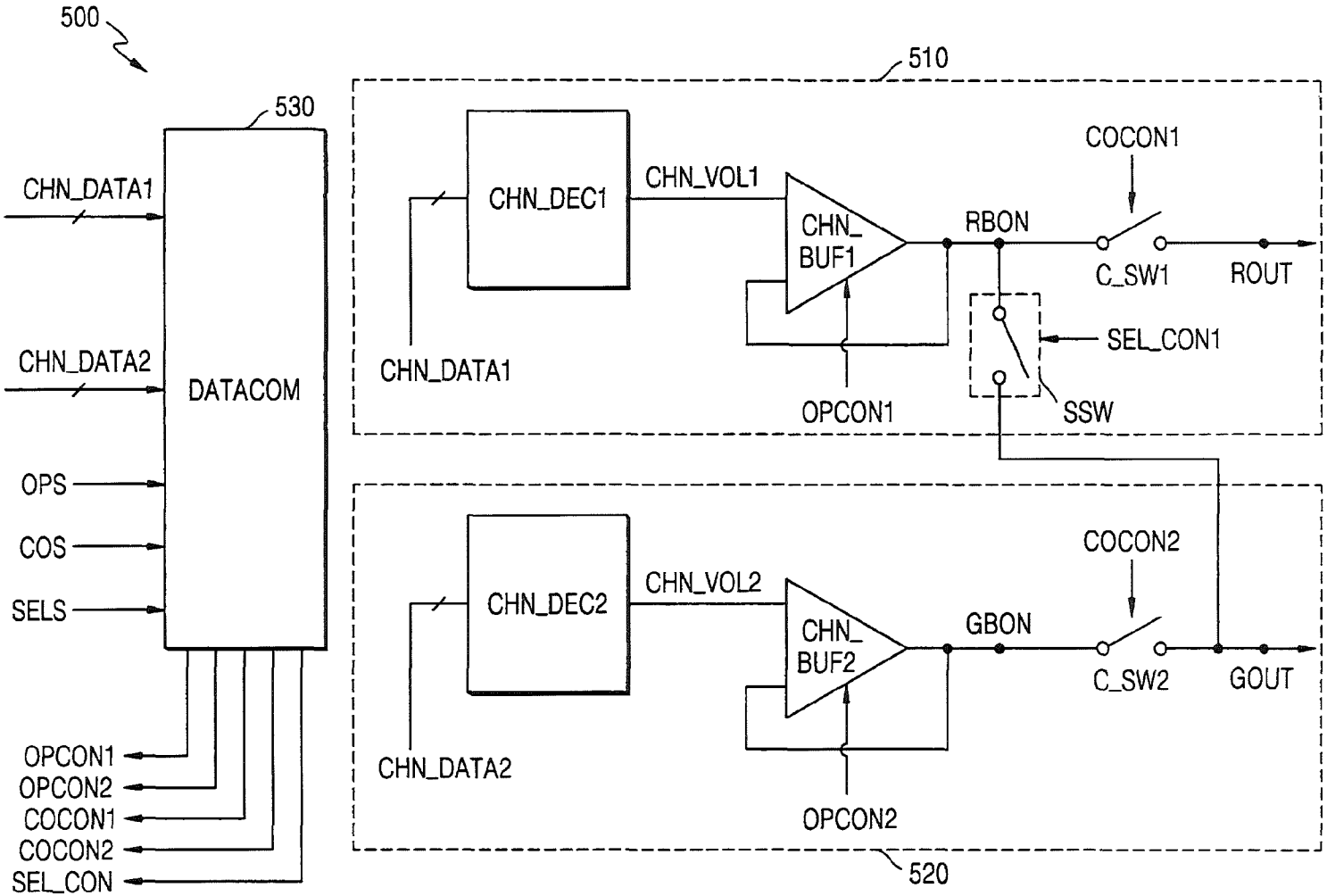
FIG. 6 a schematic diagram of a portion of a circuit for driving source lines of a display device according to additional embodiments of the present invention.

FIG. 6 illustrates a source line driver circuit 600 according to further embodiments of the present invention where the comparison of values to be driven onto a source line are for a single pixel. As used herein, a "channel" refers to a component of a pixel. Thus, for example, in an RGB system, a pixel will have a red channel, a green channel and a blue channel. While the embodiments illustrated in FIG. 6 compare data from two channels of a pixel, additional channels of the pixel may also be compared and the corresponding drivers controlled based on such a comparison.

As seen in FIG. 6, a first source line driver circuit 510 for a first channel of a pixel and a second source line driver circuit 520 for a second channel of the pixel are controlled by a data comparator circuit 530. The data comparator circuit 530 receives as input, data for channels of the pixel driven by the source line driver circuits 510, 520 and, optionally, common control signals for controlling operation of the source line driver circuits such as the source line driver circuits 510, 520. The data comparator circuit 530 uses the received channel data and, optionally, control signals, to generate individual control signals to provided coordinated control of the source line driver circuits 510, 520.

As seen in FIG. 6, in some embodiments of the present invention, the channel data CHN_DATA1 and CHN_DATA2 is provided to the data comparator circuit 530 and to respective channel decoder circuits (CHN_DEC1 and CHN_DEC2) of the source line driver circuits 510, 520. The channel decoder circuits (CHN_DEC1 and CHN_DEC2) convert the digital channel data to analog values (CHN_VOL1 and CHN_VOL2) which are provided to corresponding buffer amplifiers (CHN_BUF1 and CHN_BUF2).

The buffer amplifiers are controlled by corresponding control signals OPCON1 and OPCON2 to selectively deactivate, or set to an off state, the buffer amplifiers. The outputs (RBON and GBON) of the buffer amplifiers (CHN_BUF1 and CHN_BUF2) are selectively coupled to corresponding output lines ROUT and GOUT of the source line driver circuits 510, 520 by two separately controlled switches (C_SW1 and C_SW2). The first switch C_SW1 is controlled by the control signal COCON1 and the second switch C_SW2 is controlled by the control signal COCON2.

Furthermore, the output RBON of the buffer amplifier CHN_BUF1 is selectively coupled to the output line GOUT by a third switch SSW. The third switch SSW is controlled by the control signal SEL_CON.

The OPS, COS and/or SELS signals may be global select and control signals that are used in generating the channel level control signals OPCON1, OPCON2, COCON1, COCON2 and/or SEL_CON. The signals OPS, COS and/or SELS may also be provided as test mode signals that are passed through by the data comparator circuit 530 to the source line driver circuits 510, 520, for example, by logic ORing corresponding ones of the signals OPS, COS and/or SELS with the pixel level control signals OPCON1, OPCON2, COCON1, COCON2 and/or SEL_CON generated by the data comparator circuit 530. In such a way, the reduced pin count test equipment may be utilized with embodiments of the present invention.

In operation, the data comparator circuit 530 compares the channel data for two channels of a pixel (CHN_DATA1 and CHN_DATA2) and if the data has the same value, controls the source line driver circuits 510, 520 to disable the buffer CHN_BUF2 of the second source line driver circuit 520 and drive the outputs ROUT and GOUT with the first source line driver circuit 510. Thus, the buffer amplifier CHN_BUF1 provides a common buffer amplifier for the two channels of pixel data based on a comparison of the data for the two channels. In particular, the following truth table describes the state of the control signals based on the results of the data comparison

| Comparison | OPCON1 | OPCON2 | COCON1 | COCON2 | SEL_CON |
|---|---|---|---|---|---|
| CHN_DATA1 = CHN_DATA2 | Active | Inactive | Active | Inactive | Active |
| CHN_DATA1 ≠ CHN_DATA2 | Active | Active | Active | Active | Inactive |

In the above table, an active signal results in closure of the corresponding switches or activation of the buffer amplifier. Thus, for example, when OPCON2 is active, the buffer amplifier CHN_BUF2 is enabled and when it is inactive, the buffer amplifier CHN_BUF2 is disabled. Similarly, when the signal SEL_CON is active, the switch SSW is closed and when the signal SEL_CON is inactive, the switch SSW is open.

Figure 7A:
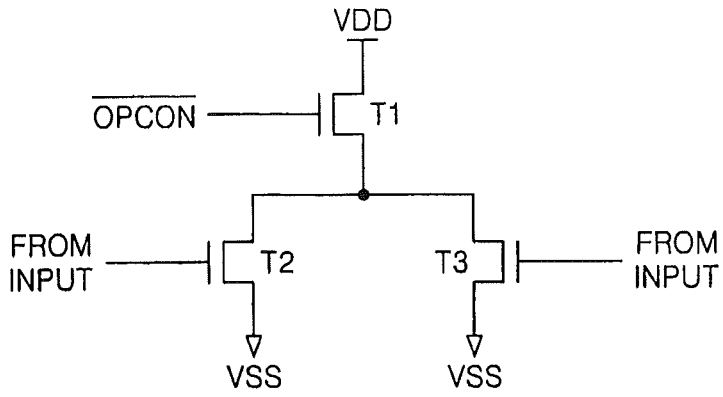
FIGS. 7A and 7B are schematic diagrams of portions of amplifier circuits illustrating techniques for disabling to the amplifier circuits so as to reduce power consumption.
Figure 7B:
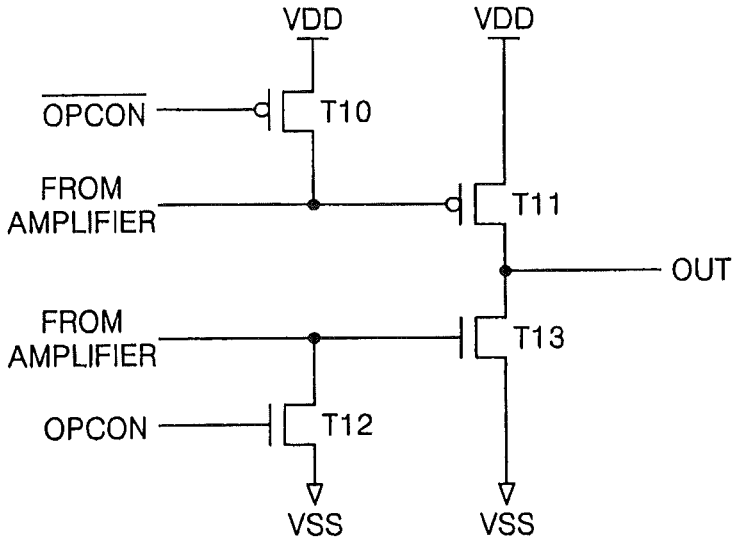

FIGS. 7A and 7B are schematic illustrations of portions of buffer amplifiers suitable for use in some embodiments of the present invention. FIG. 7A illustrates a portion of an input circuit of a buffer amplifier that includes input transistors T2 and T3 and control transistor T1. The control transistor T1 may selectively decouple the input transistors T2 and T3 from a voltage source, such as VDD, to thereby reduce or eliminate the current flow in the input circuit of the buffer amplifier.

Similarly, FIG. 7B illustrates a portion of an output circuit of a buffer amplifier that includes output transistors T11 and T13 and control transistors T10 and T12. The control transistors T10 and T12 may selectively couple the gates of the input transistors T11 and T13 to a voltage source, such as VDD or VSS, to turn off the transistors T11 and T13 and thereby reduce or eliminate the current flow in the output circuit of the buffer amplifier.

Figure 8:
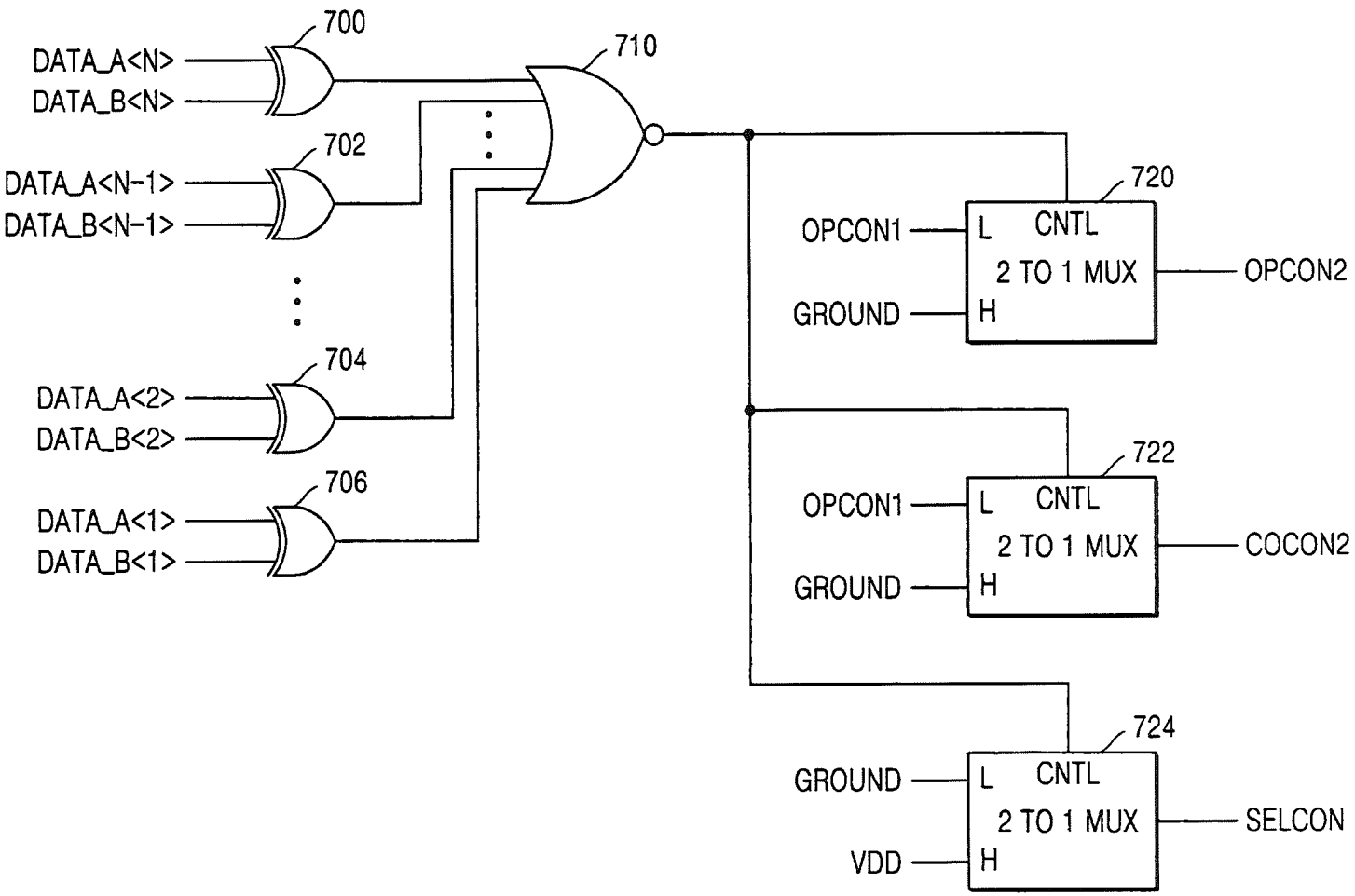
FIG. 8 is a schematic diagram of a control circuit according to some embodiments of the present invention.

FIG. 8 is a schematic illustration of a data comparator circuit that generates control signals for controlling source line drivers, such as those illustrated in FIGS. 3, 4, 5 and/or 6. As seen in FIG. 8, a first 1 through N bits of input data DATA_A<1> . . . DATA_A<N> are compared to corresponding ones of a second 1 through N bits of input data DATA_B<1> . . . DATA_B<N> by performing an EXCLUSIVE OR function on respective bit pairs using, for example, XOR gates such as the XOR gates 700, 702, 704 and 706. The output of the XOR gates 700, 702, 704 and 706 is logically NORed together using an N input NOR gate 710 and the output of the NOR gate 710 is used to control the multiplexers 720, 722 and 724 to generate the control signals. In certain embodiments, the output of the multiplexers 720, 722 and 724 may be logically ORed (not shown) with the signals OPS, COS and/or SELS respectively as discussed above.

The output of the NOR gate 710 is provided to a first 2 to 1 MUX 720 that has as inputs OPCON1 and Ground. When the output of the NOR gate 710 is a logic "low" value indicating that at least one of the bit pairs does not match, OPCON1 is provided as the OPCON2 signal and the buffer amplifiers are active. When the output of the NOR gate 710 is a logic "high" value indicating that all of the bit pairs match, Ground is provided as the OPCON2 signal and the second buffer amplifier(s) is/are inactive.

The output of the NOR gate 710 is also provided to a second 2 to 1 MUX 722 that has as inputs COCON1 and Ground. When the output of the NOR gate 710 is a logic "low" value, indicating that at least one of the bit pairs does not match, COCON1 is provided as the COCON2 signal and the buffer amplifiers are coupled to their respective output lines. When the output of the NOR gate 710 is a logic "high" value indicating that all of the bit pairs match, Ground is provided as the OPCON2 signal and the second buffer amplifier(s) is/are isolated from its/their output line(s).

The output of the NOR gate 710 is also provided to a third 2 to 1 MUX 724 that has as inputs VDD and Ground. When the output of the NOR gate 710 is a logic "low" value indicating that at least one of the bit pairs does not match, Ground is provided as the SELCON signal and the first buffer amplifier(s) is/are isolated from the output line(s) associated with the second buffer amplifier(s). When the output of the NOR gate 710 is a logic "high" value indicating that all of the bit pairs match, VDD is provided as the SELCON signal and the first buffer amplifier(s) is/are coupled to the second buffer amplifier(s) output line(s).

The data comparison circuit of FIG. 8 has been illustrated with reference to XOR gates and a NOR gate to provide the comparison of data bits. However, as will be appreciated by those of skill in the art, other logic circuit configurations may be provided to perform the data comparison function. For example, XNOR gates may be used to compare bits and an AND gate used to aggregate the comparison. Furthermore, by inverting the MUX inputs, the NOR or AND gate that aggregates the XOR output may be an OR or NAND gate. Likewise, while the aggregating logic gate is illustrated as an N-input gate, multiple logic gates could be utilized to provide the function of the aggregating logic gate. Accordingly, embodiments of the present invention should not be construed as limited to the particular logic gate configuration illustrated in FIG. 8.

While embodiments of the present invention are described and illustrated herein with reference to "switches" the reference to switches refers to a switching device and may be solid state, mechanical or otherwise. Thus, for example, in certain embodiments of the present invention, the switches C_SW1, C_SW2, R_SW1, G_SW1, B_SW1, R_SW2, G_SW2, B_SW2, SSW, SSW1, SSW2 and SSW3 may be provided as transistors. Accordingly, embodiments of the present invention should not be construed as limited to a particular switching device but may utilize any device capable of selectively connecting the amplifiers to the outputs. Furthermore, signals may be active high or active low depending on the particular configuration of the circuit. Thus, embodiments of the present invention should not be construed as limited to a particular polarity of operation.

Additionally, embodiments of the present invention have been described with reference to RGB data, however, other types of data, such as YPrB data may also be utilized to compare pixel values at the pixel and/or channel level. Furthermore, additional comparisons may also be provided where, for example, more that three components are provided. For example, if a white (W) component is provided a comparison of pixel/channel values may also include and/or be made based on the W value. Accordingly, embodiments of the present should not be construed as limited to the RGB examples discussed herein but may be utilized with any system that allows comparison of values for a pixel and/or channel of a pixel.

Embodiments of the present invention have been described with reference to a comparison of values associated with two pixels or of two channels for a pixel. However, in other embodiments of the present invention, values from more than two pixels/channels may be compared. In such embodiments, the output of a buffer amplifier may be selectively coupled to more than two source lines. Also, the particular outputs that a buffer amplifier is coupled to may be selected based on the comparison or may be fixed. Thus, for example, where values for more than two pixels are compared, control may be based on all values being equal or any two or more values being equal. Combinations of pixel and/or channel level comparisons may also be provided. For example, when two channels are compared, the two channels may be from the same and/or different pixels.

Additionally, which values are compared may be static or dynamic. Thus, for example, a rolling comparison of values may be carried out where a value for a first pixel is compared to a value for a second pixel and then the value for the second pixel is compared to a value for a third pixel and this pattern repeated. Alternatively or additionally, in a static system a value for a first pixel is compared to a value for a second pixel and a value for a third pixel is compared to a value for a fourth pixel.

While the present invention has been particularly shown and described with reference to particular embodiments thereof, it will be understood by those of ordinary skill in the art that various changes in form and details may be made therein without departing from the spirit and scope of the present invention as defined by the following claims.

The invention claimed is:

1. A method of driving source lines of a display device, comprising:

comparing first data input into a first buffer associated with a first source line of the display device with second data input into a second buffer associated with a second source line of the display device;

controlling the first buffer and the second buffer according to the comparison of the first data and the second data, wherein the controlling the first buffer and the second buffer comprises disabling the second buffer and enabling the first buffer when the first data and the second data have a same value; and electrically connecting the first source line and the second source line when the first data and the second data have the same value.

2. The method of claim 1, wherein the first data is a first display data comprising a plurality of first color data, and the second data is a second display data comprising a plurality of second color data.

3. The method of claim 2, wherein the first color data comprises first red data, first green data and first blue data, and the second color data comprises second red data, second green data and second blue data.

4. The method of claim 3, wherein the first source line comprises a first red source line, a first source green line and a first blue source line, and the second source line comprises a second red source line, a second green source line and a second blue source line.

5. The method of claim 4, wherein the first buffer comprises a first red source line buffer, a first green source line buffer and a first blue source line buffer and the second buffer comprises a second red source line buffer, a second green source line buffer and a second blue source line buffer.

6. The method of claim 4, wherein the first buffer is shared by the first red source line, the first source green line and the first blue source line and the second buffer is shared by the second red source line, the second green source line and the second blue source line.

7. The method of claim 3, wherein the first source line comprises one of a first red source line, a first source green line and a first blue source line, and the second source line comprises one of a second red source line, a second green source line and a second blue source line.

8. The method of claim 3, wherein the comparing compares the first red data with the second red data, the first green data with the second green data, or the first blue data with the second blue data.

9. The method of claim 3, wherein the comparing compares the first red data with one of the second green data and the second blue data, the first green data with one of the second red data and the second blue data, or the first blue data with one of the second green data and the second red data.

10. The method of claim 2, wherein the first source line and the second source line are source lines for different pixels.

11. The method of claim 2, wherein the first source line and the second source line are source lines for a same pixel.

12. The method of claim 1, wherein the first data comprises one of first red data, first green data or first blue data, and the second data comprises one of second red data, second green data or second blue data.

13. The method of claim 12, wherein the first buffer comprises a first red source line buffer, a first green source line buffer and a first blue source line buffer and the second buffer comprises a second red source line buffer, a second green source line buffer and a second blue source line buffer.

14. The method of claim 12, wherein the first buffer is shared by the first red source line, the first source green line and the first blue source line and the second buffer is shared by the second red source line, the second green source line and the second blue source line.

15. The method of claim 12, wherein the comparing compares the first red data with the second red data, the first green data with the second green data, or the first blue data with the second blue data.

16. The method of claim 12, wherein the comparing compares the first red data with one of the second green data and the second blue data, the first green data with one of the second red data and the second blue data, or the first blue data with one of the second green data and the second red data.

17. The method of claim 12, wherein the first source line and the second source line are source lines for different pixels.

18. The method of claim 12, wherein the first source line and the second source line are source lines for a same pixel.

19. The method of claim 1, wherein the second buffer is disabled, the second data outputs through the first source line.

* * * * *